US008100505B2

(12) United States Patent
Kuroda et al.

(10) Patent No.: US 8,100,505 B2
(45) Date of Patent: Jan. 24, 2012

(54) LIQUID EJECTING HEAD AND MANUFACTURING DIMENSION CONTROL METHOD

(75) Inventors: Tomotsugu Kuroda, Kawasaki (JP); Toru Yamane, Yokohama (JP); Mikiya Umeyama, Tokyo (JP); Masaki Oikawa, Inagi (JP); Yuichiro Akama, Kawasaki (JP); Chiaki Muraoka, Kawaguchi (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/326,481

(22) Filed: Dec. 2, 2008

(65) Prior Publication Data

US 2009/0147050 A1 Jun. 11, 2009

(30) Foreign Application Priority Data

Dec. 6, 2007 (JP) ..... 2007-315820

(51) Int. Cl.
*B41J 2/14* (2006.01)

(52) U.S. Cl. ..... 347/47; 347/48; 347/49; 347/50; 347/51; 347/52; 347/53; 347/54; 347/55; 347/56; 347/57

(58) Field of Classification Search ..... 347/47–57
See application file for complete search history.

(56) References Cited

U.S. PATENT DOCUMENTS

| | | | | |
|---|---|---|---|---|
| 6,139,761 | A | 10/2000 | Ohkuma | |
| 6,497,474 | B2 * | 12/2002 | Irinoda et al. | 347/54 |
| 6,688,732 | B2 * | 2/2004 | Mitsuhashi et al. | 347/70 |
| 6,695,437 | B2 * | 2/2004 | Nakamura et al. | 347/70 |
| 6,931,702 | B2 * | 8/2005 | Mitsuhashi et al. | 29/25.35 |
| 7,438,389 | B2 * | 10/2008 | Katayama | 347/50 |
| 7,810,909 | B2 * | 10/2010 | Shingyohuchi | 347/54 |
| 7,837,299 | B2 * | 11/2010 | Mori | 347/45 |
| 2002/0175975 | A1 * | 11/2002 | Mitsuhashi et al. | 347/70 |
| 2003/0081079 | A1 * | 5/2003 | Mitsuhashi et al. | 347/68 |
| 2004/0104977 | A1 * | 6/2004 | Mitsuhashi et al. | 347/68 |

FOREIGN PATENT DOCUMENTS

JP 402165962 A * 6/1990 ..... 347/56

* cited by examiner

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

A liquid ejecting head includes a substrate, a nozzle forming member for forming on a principal surface of the substrate a nozzle comprising a flow passage of liquid and an orifice for ejecting the liquid, and a dummy pattern. The dummy pattern has substantially the same dimension as at least a part of the nozzle and is formed so that a cross-section of the dummy pattern is exposed at an end surface of the nozzle forming member.

6 Claims, 8 Drawing Sheets

LIQUID EJECTING HEAD AND MANUFACTURING DIMENSION CONTROL METHOD

FIELD OF THE INVENTION AND RELATED ART

The present invention relates to a liquid ejecting head for ejecting liquid by externally applying energy to the liquid and a manufacturing dimension control method of the liquid ejecting head.

As a nozzle manufacturing method of an ink jet recording head, particularly a thermal ink jet recording method for ejecting ink through bubble generation by heating the ink, there have been conventionally used a method of laminating a resin material on a silicon substrate (silicon wafer) and a method of applying a nozzle plate onto the silicon substrate. In both methods, after nozzle formation, the silicon substrate has been cut by a dicer to be separated into respective chips.

In these days, similar liquid droplets of ink are desired in order to realize a high image quality. It has been known that delicate variation of a nozzle dimension during manufacturing has an influence on ejection and by extension on an image quality. Thus, in a situation such that the high image quality is desired, in the method of applying the nozzle plate onto the silicon substrate, dimensional tolerance such as a vertical or front-rear warp of the nozzle plate or insufficient application accuracy has an influence on ejection stability and an amount of ejection. Therefore, as the nozzle manufacturing method, as described in U.S. Pat. No. 6,139,761, the method of laminating the resin material on the silicon substrate becomes dominant. Further, in order to realize the smaller liquid droplets and the stable ejection for the purpose of a higher image quality, such a need that a nozzle dimension control method is intended to be strictly adopted has been increased more than ever before.

As a nozzle dimension measuring method for filling such a need, two methods have been principally known. One method is such that a microscope is used to observe a liquid ejection port from above a nozzle forming member to measure a nozzle dimension. The other method is such that a TEG chip (a chip for inspecting a nozzle shape) or a non-defective chip is pulled out and the nozzle dimension is measured from its cutting plane.

However, these conventional nozzle dimension measuring methods have been accompanied with the following problems. First, in the observation method through the microscope from above, in the case where a tapered shape with respect to a substrate thickness direction (Z direction) is to be observed, there arises such a problem that a position of an edge of a nozzle shape pattern with respect to a horizontal direction (X direction and Y direction) of a substrate surface is detected so as to vary depending on a focus position. For this reason, measurement accuracy is low, so that the method cannot sufficiently fill the need for dimension measurement accuracy at a high level which has been required in recent years.

On the other hand, in the cutting plane inspection of the pulled out TEG chip or non-defective chip, the dimension measurement accuracy is higher than that of the above observation method but involves the following three problems.

A first problem is such that the cutting plane inspection is a destructive inspection in which the TEG chip or the non-defective chip is cut, thus resulting in an increased cost. A second problem is such that a cutting step is an additional step to complicate a manufacturing method, thus increasing a production cost. A third problem is such that the number of inspection points for enhancing the measurement accuracy cannot be increased. That is, when the number of inspection points for enhancing the measurement accuracy is increased, an available chip number per (one) wafer is decreased to result in a considerable increase in cost, so that the inspection points have to be actually limited to several points on the wafer. As a result, dimensional variation on the wafer cannot be accurately kept track of, thus lowering the measurement accuracy.

SUMMARY OF THE INVENTION

In view of the above-described problems, a principal object of the present invention is to improve dimension measurement accuracy of a nozzle.

Another object of the present invention is to reduce a cost in a manufacturing dimension control step of the nozzle.

According to an aspect of the present invention, there is provided a liquid ejecting head comprising:

a substrate;

a nozzle forming member for forming on a principal surface of the substrate a nozzle comprising a flow passage of liquid and an orifice for ejecting the liquid; and a dummy pattern, wherein the dummy pattern has substantially the same dimension as at least a part of the nozzle and is formed so that a cross section of the dummy pattern is exposed at an end surface of the nozzle forming member.

According to the present invention, it is possible to improve the dimension measurement accuracy of the nozzle and also to reduce the cost in the manufacturing dimension measurement accuracy of the nozzle.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings. In the following description, as the liquid ejecting head of the present invention, an ink jet recording head is described as an example but the present invention is not limited thereto.

First Embodiment

FIG. 1 to FIGS. 7A-7D are schematic views for illustrating a First Embodiment of the present invention.

Figure 1:
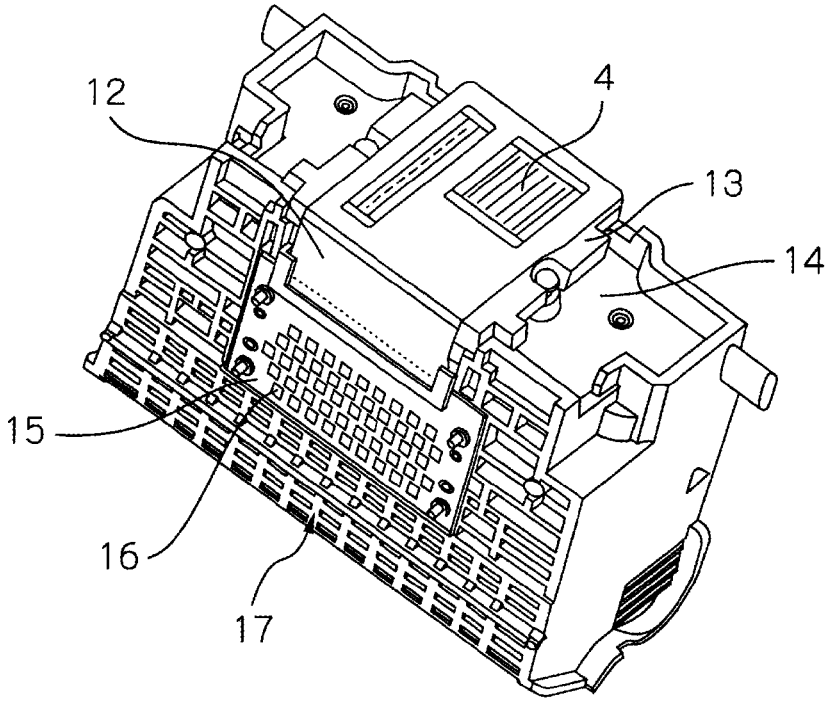
FIG. 1 is a perspective view of an outer appearance of an embodiment of the liquid ejecting head of the present invention.
Figure 2:
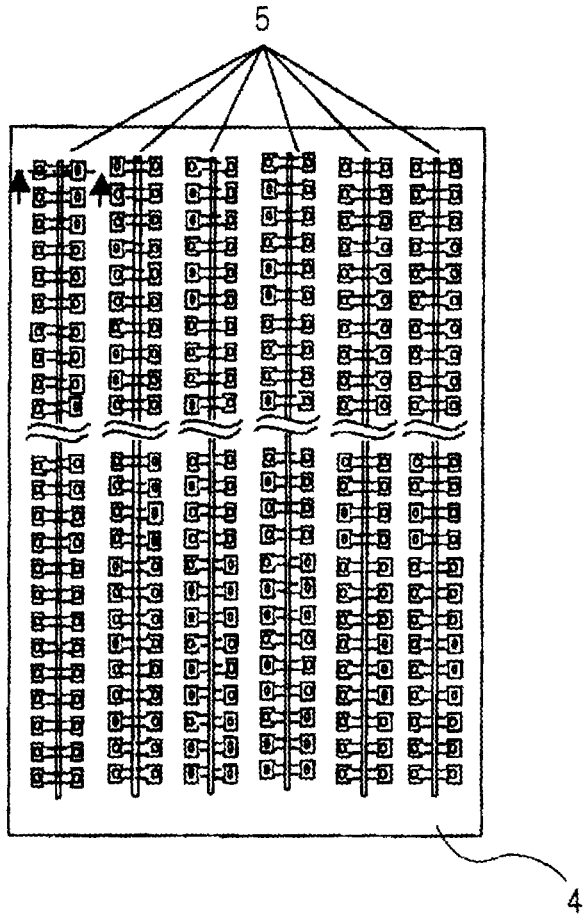
FIG. 2 is an enlarged view of a chip (nozzle) shown in FIG. 1.

FIG. 1 is a perspective view of an outer appearance of a liquid ejecting head of the present invention in this embodiment. FIG. 2 is an enlarged view of a chip 4 shown in FIG. 1, and FIG. 3 is a schematic sectional view of a nozzle cut along a plane indicated by a chain line shown in FIG. 2.

Referring to FIG. 1, a liquid ejecting head 17 is constituted by the chip 4, an electric circuit substrate 15, a flexible circuit substrate 12, a supporting member 13 for supporting the chip 4, and a fixing member 14 for fixing the supporting member 13.

The liquid ejecting head 17 introduces an electric signal externally inputted through electrical contacts 16 of the electric circuit substrate 15 into the chip 4, mounted on the liquid ejecting head 17, through the flexible circuit substrate 12.

Figure 3:
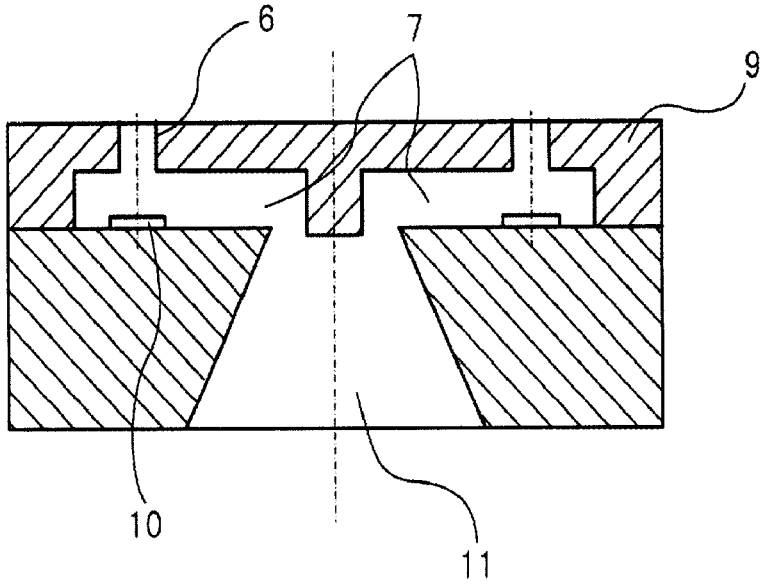
FIG. 3 is a schematic sectional view of the nozzle taken along a chain line (alternate long and short dashed lines) indicated by arrows shown in FIG. 2.

The chip 4 includes, as shown in FIG. 3, a plurality of heaters 10 disposed on a principal surface of a substrate, a plurality of flow passages 7 for guiding liquid to the respective heaters 10, orifices 6 for ejecting the liquid in the flow passages 7 causing bubble generation by heat of the heaters 10, and a supply port 11 for supplying the liquid to the flow passages 7. The flow passages 7 and the orifices 6 constitute a nozzle forming member 9.

The liquid to be ejected from the chip 4 is supplied from an unshown liquid retaining container via the supply port 11 and branches off into the plurality of orifices 6. Then, the liquid in the neighborhood of the heater 10 causes film boiling by heating the heater 10 by thermal energy depending on the electric signal from the electric circuit substrate 15, thus being gasified. The liquid is ejected from the orifice 6 by kinetic energy due to the gasification.

Figures 4A, 4B:
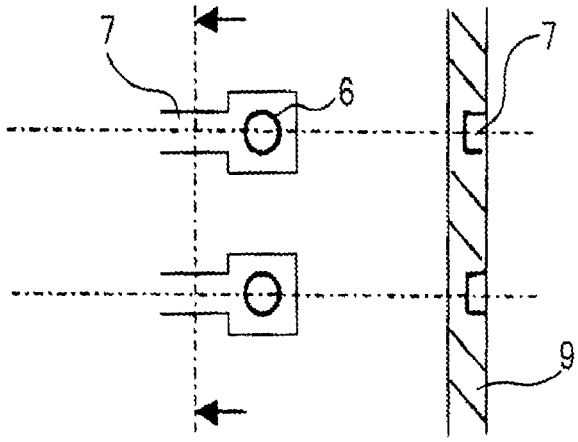
FIG. 4A is an enlarged plan view of the nozzle shown in FIG. 2
FIG. 4B is a schematic sectional view of the nozzle taken along a chain line shown in FIG. 4A.

Here, the flow passages 7 and the orifices 6 constitute the nozzles 5 (FIG. 2). FIG. 4A is an enlarged plan view of the nozzle 5 shown in FIG. 2. FIG. 4B is a schematic sectional view of the nozzle cut along a plane indicated by a chain line shown in FIG. 4A.

Next, a manufacturing process of the chip (nozzle chip) 4 as a constituent element of the liquid ejecting head 17 will be described. The liquid ejecting head 17 is provided with a nozzle group consisting of a plurality of nozzles for ejecting the liquid.

FIGS. 5A to 7C are schematic sectional views for illustrating a fundamental manufacturing method in the present invention, wherein a constitution of the liquid ejecting head of the present invention and an example of a manufacturing procedure the liquid ejecting head are shown in each of FIGS. 5A to 7C.

Figure 5A:
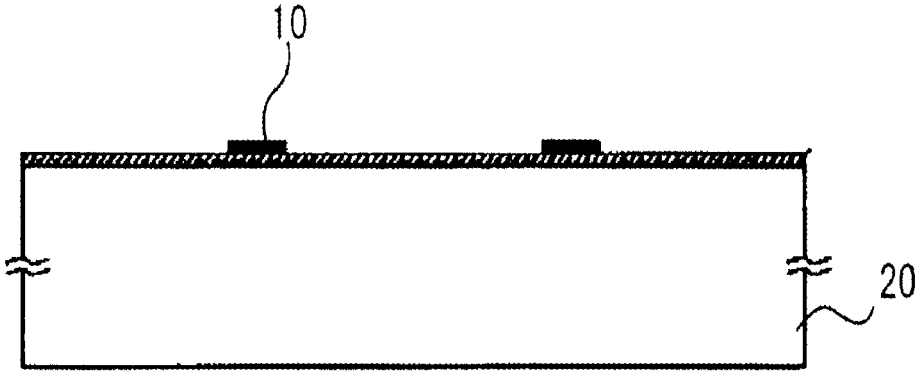
FIGS. 5A to 5D, FIGS. 6A to 6D, and FIGS. 7A to 7D are schematic sectional views for illustrating an embodiment of a manufacturing procedure of the liquid ejecting head of the present invention.

First, as shown in FIG. 5A, on a surface (principal surface) of a silicon substrate 20, a desired number of heaters 10 are disposed via a layer of silicon oxide or silicon nitride. The layer of silicon oxide or silicon nitride functions as a stop layer for an isotropic etching described later.

Figure 5B:
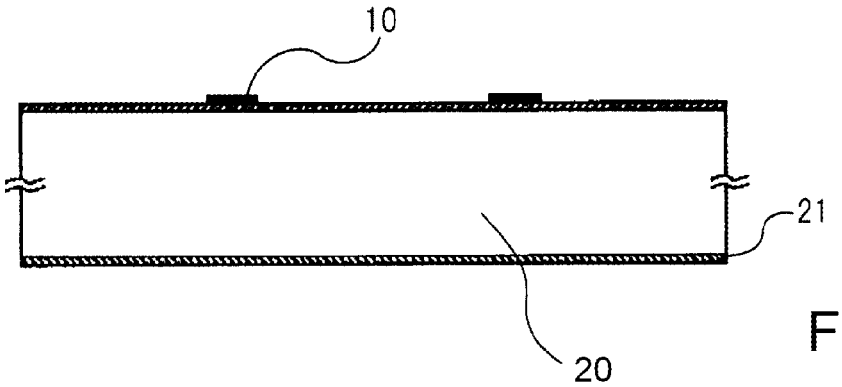
Figure 5C:
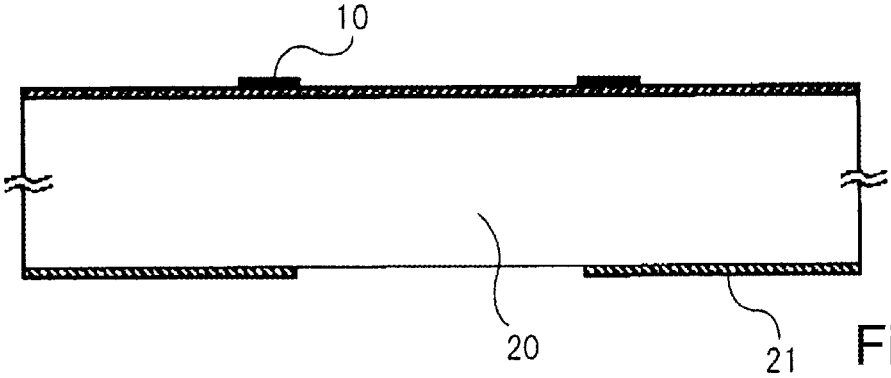

Next, as shown in FIG. 5B, a resin material constituting a mask for forming an ink supply port (hereinafter referred to as a "mask member 21") is applied onto a surface (back surface) on which the heaters 10 for the substrate 20 are not formed. Thereafter, in order to open desired points of the mask member 21, a photosensitive resin material is applied onto both surfaces of the substrate 20 and is subjected to light exposure in a desired pattern, so that the photosensitive resin material is changed into a substance soluble in a developing liquid at the exposed portion thereof. The exposed pattern portion is dissolved by the developing liquid to expose an etching surface, followed by ashing and patterning. Thereafter, the photosensitive resin material which functioned as the etching mask is removed to create a state shown in FIG. 5C.

Figure 5D:
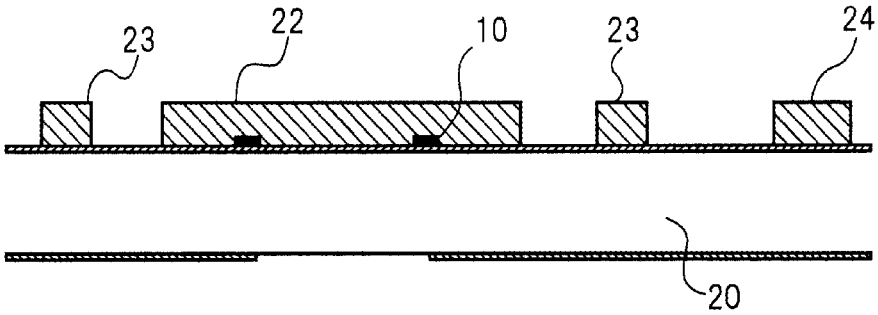

Next, a resin material constituting a mold for a liquid flow passage (hereinafter referred to as a "mold") is applied onto the substrate 20, followed by light exposure and development. As a result, as shown in FIG. 5D, a mold 22 for the ink flow passage, a base 23 for uniformly applying the nozzle forming member, and a base 24 for forming a nozzle dummy pattern (hereinafter referred to as a "dummy pattern base") are formed.

Figure 6A:
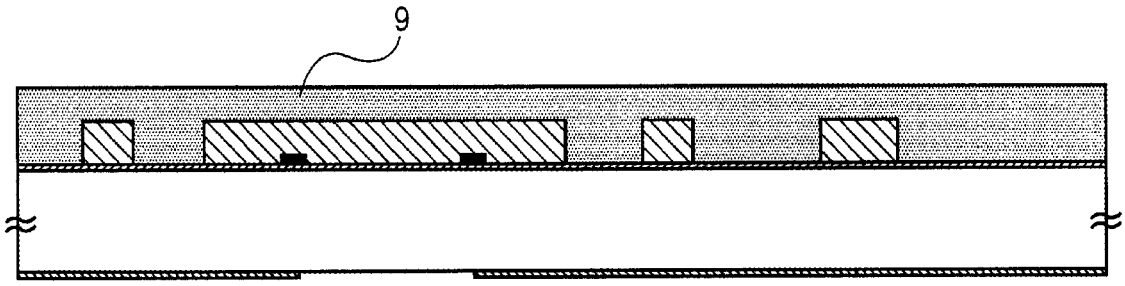
Figure 6B:
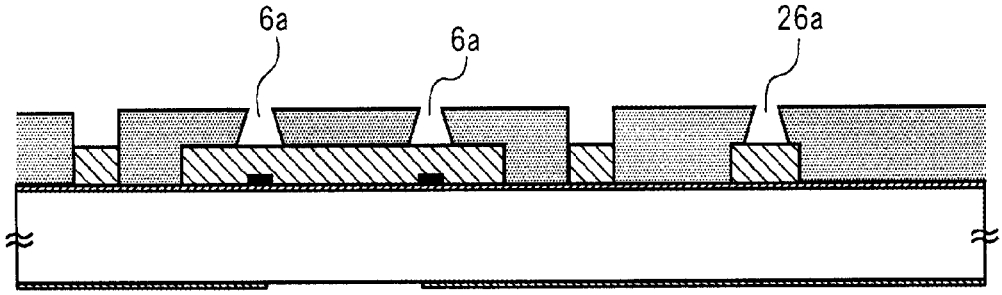

Then, as shown in FIG. 6A, a resin material for forming a nozzle forming member 9 is uniformly applied onto the surface of the substrate 20. Then, the nozzle forming member 9 is exposed to light of a desired pattern to change the resin material to a thermosetting substance at the (light-)exposed portion. Next, heat is applied to the substance to cure the exposed portion and an unexposed portion is dissolved by the developing liquid, so that an ink ejection outlet 6*a* and an ejection outlet 26 for a dummy nozzle are formed as shown in FIG. 6B.

Figure 6C:
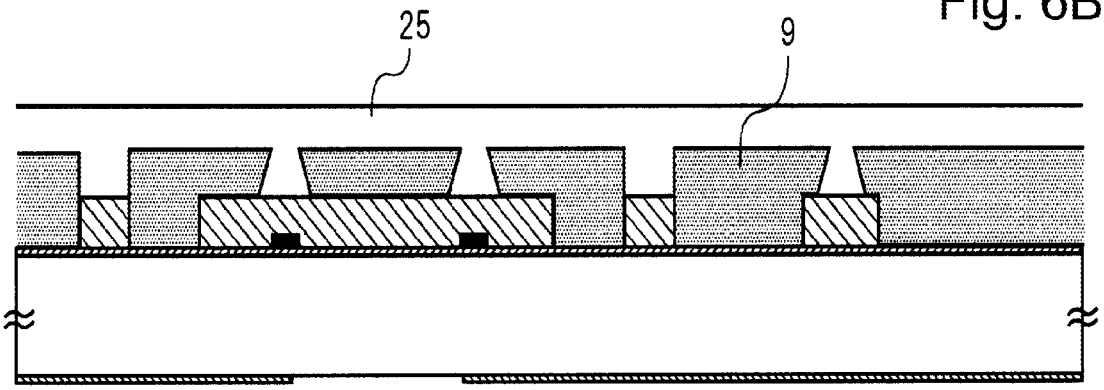

Next, as shown in FIG. 6C, a nozzle protecting material 25 is applied onto the nozzle forming member 9 as a film for protecting the nozzle forming member 9 from an anisotropic etching liquid.

Figure 6D:
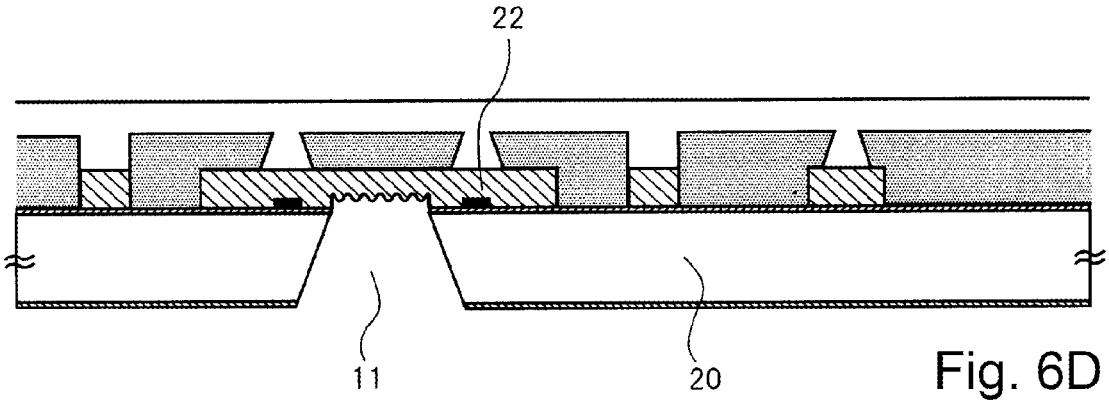

Thereafter, the back surface of the silicon substrate 20 is subjected to plasma dry etching with $CF_4$ or the like to remove the film (layer) of silicon oxide or silicon nitride corresponding to the ink flow passage mold 22 to cause an ink supply port 11 to penetrate through the substrate 20 as shown in FIG. 6D.

Figure 7A:
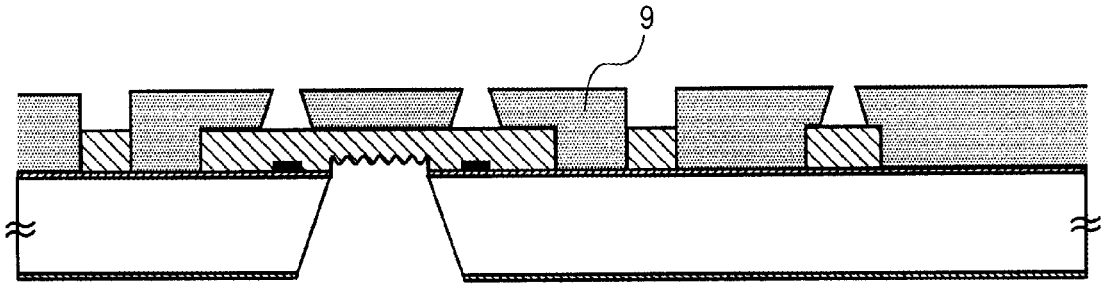
Figure 7B:
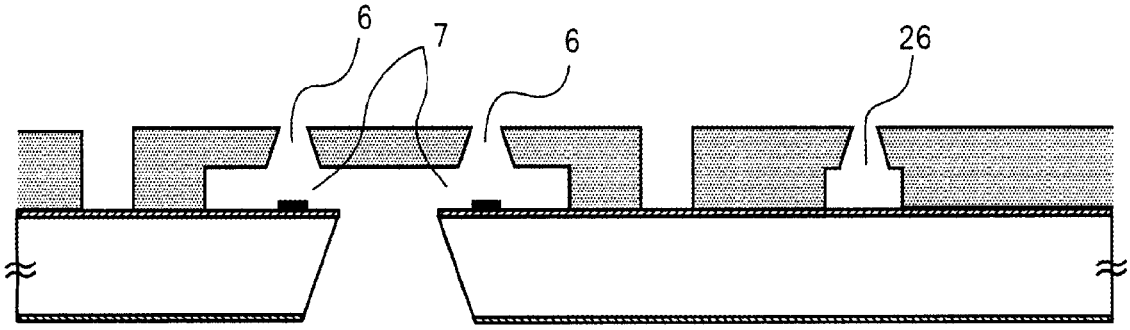

Then, the nozzle protecting material 25, which is no longer needed, is removed to create a state shown in FIG. 7A and finally, the flow passage mold 22, the base 23, and the dummy pattern base 24 are removed. As a result, as shown in FIG. 7B, a nozzle 5 consisting of the flow passage 7 and the orifice 6 and a nozzle dummy pattern 26 are formed.

Figure 7C:
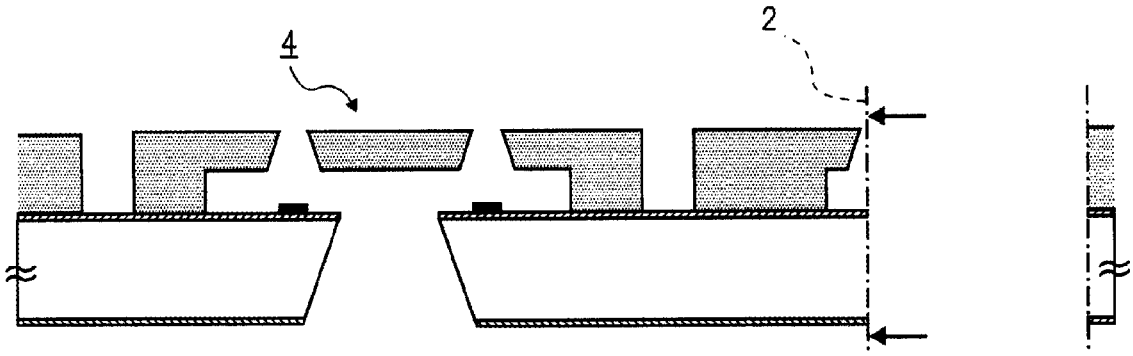
Figure 7D:
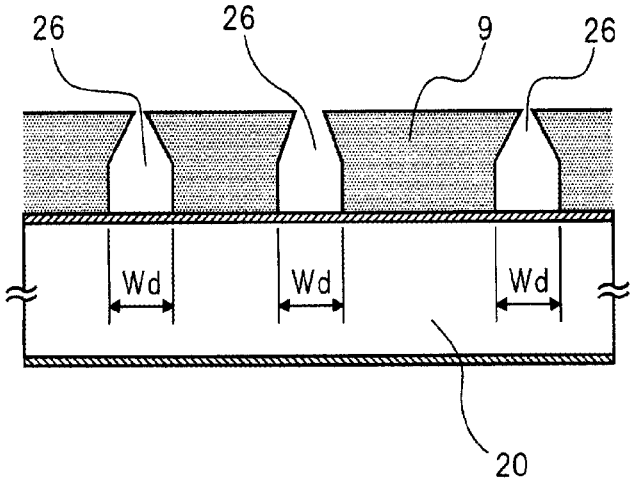

The above-described steps are a series of steps until the nozzle 5 and the nozzle dummy pattern 26 are prepared on the silicon substrate 20. Thereafter, the silicon substrate on which the nozzle 5 and the nozzle dummy pattern 26 are formed (hereinafter referred to as a "nozzle substrate") is cut along a plurality of scribe lines 2 provided at predetermined positions to obtain chips 4 (FIG. 7C). FIG. 7D is a schematic sectional view of the nozzle substrate cut along the scribe line 2 indicated by a chain line shown in FIG. 7C.

The nozzle dummy pattern 26 is prepared by the above-described manufacturing method, so that the nozzle dummy pattern 26 has substantially the same dimension as the nozzle 5 and includes a plurality of nozzle dummy pattern portions provided along the scribe lines 2 of the nozzle forming member 9. Then, by the cutting along the scribe lines 2, the plurality of nozzle dummy pattern portions 26 is exposed at a cross-section thereof as shown in FIG. 7D. This cross-section corresponds to an end surface of the nozzle forming member 9 when the chip 4 is completed. Therefore, by measuring a dimension Wd of respective dimensions of the cross-section exposed portion of the dummy pattern 26, it is possible to facilitate dimension control of the flow passages 7. That is, during the manufacturing process of the chip 4, the dimension Wd of the dummy pattern 26 is made substantially equal to a width of the flow passage 7, so that it is possible to substitute the dimension measurement of the cross-section exposed portion of the dummy pattern 26 for the dimension control of the flow passages 7.

As described above, in the present invention, a structure having the same dimension as a dimension of the flow passage as a part of the nozzle is provided along the scribe line (cutting line) and design is made so that a cutting plane of the structure is exposed by cutting, so that it is possible to easily and inexpensively perform nozzle cross-section observation with high accuracy. Specifically, the TEG chip which has been conventionally required for the cross-section observation can be eliminated to result in a reduced cost. Further, in the case of measuring the dimension through the conventional nozzle cross-section observation, the cutting step as an additional step can be eliminated, so that a manufacturing cost can be reduced. Further, even in the case of an occurrence of a problem, any chip can be measured in a nondestructive manner, so that quality control accuracy is also improved.

Embodiment 2

Figure 8A:
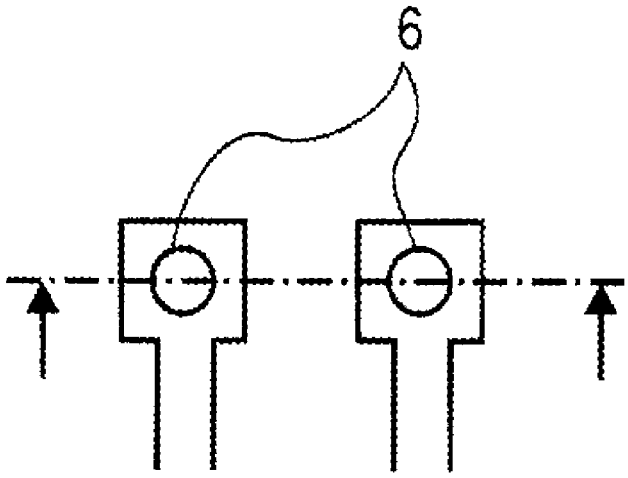
FIG. 8A is a plan view of a nozzle in a Second Embodiment and FIG. 8B is a schematic sectional view of a nozzle substrate cut at a surface indicated by a chain line shown in FIG. 8A.
Figure 8B:
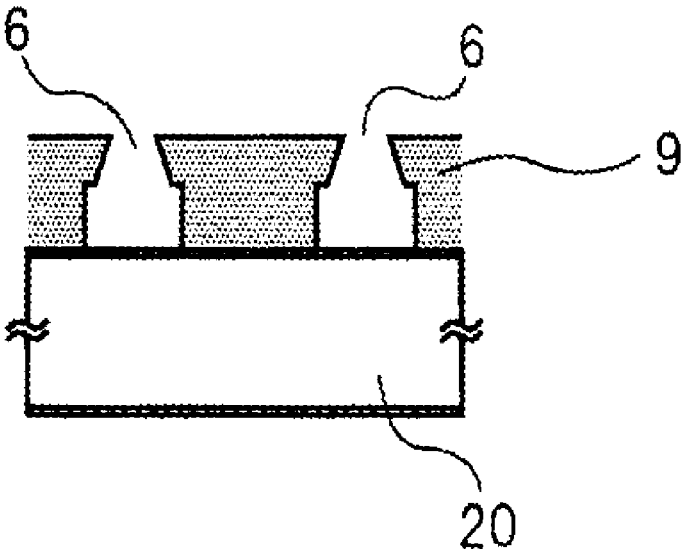

FIG. 8A is a plan view of a nozzle a Second Embodiment and FIG. 8B is a schematic sectional view of a nozzle substrate cut along a plane indicated by a chain line shown in FIG. 8A. Each orifice 6 tapers down toward an ink ejection port.

Figure 9A:
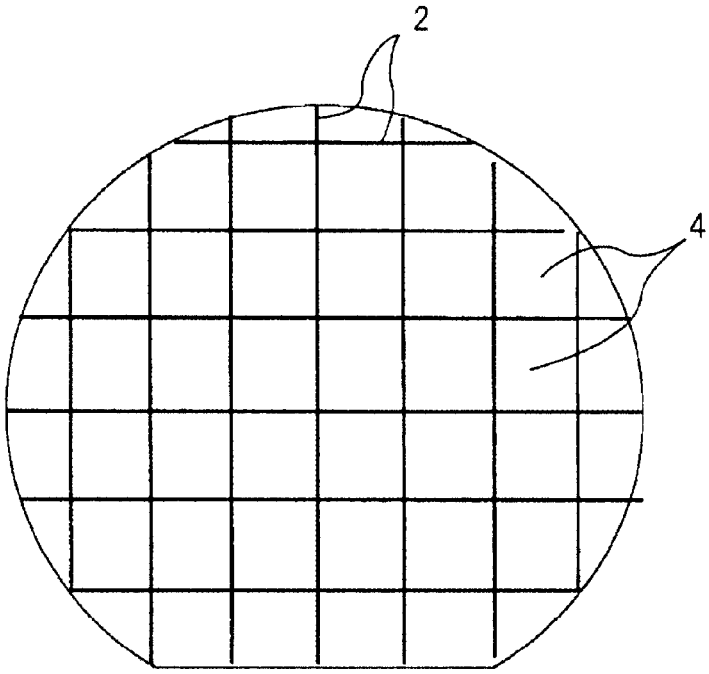
FIG. 9A is a plan view of a silicon substrate on which a plurality of nozzle chips is prepared.
Figure 9B:
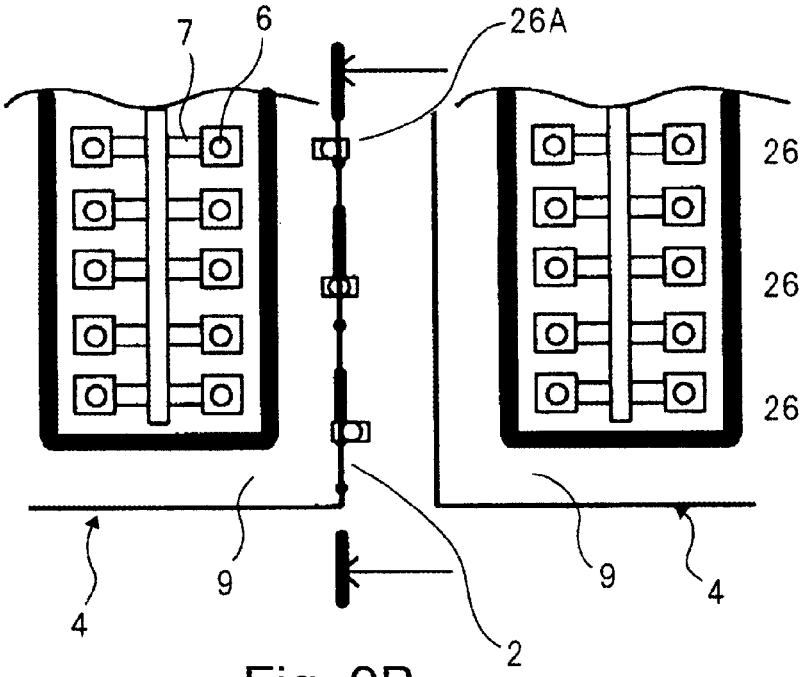
FIG. 9B is an enlarged view of the silicon substrate at a periphery of a scribe line shown in FIG. 9A.
Figure 9C:
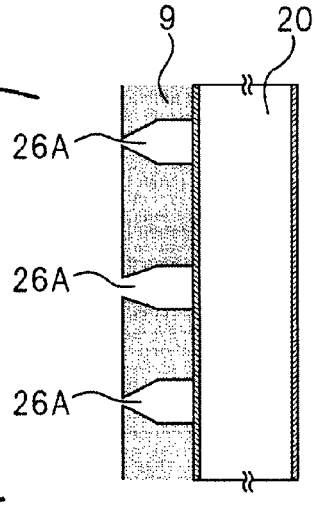
FIG. 9C is a schematic sectional view showing a cross-section exposed portion of a plurality of dummy patterns exposed by cutting the silicon substrate along a chain line shown in FIG. 9B.

FIG. 9A is a plan view of a silicon substrate (nozzle substrate) on which a plurality of chips 4 is prepared. FIG. 9B is an enlarged view showing a periphery of a scribe line 2 for cutting the nozzle substrate shown in FIG. 9A into a plurality of portions and FIG. 9C is a schematic sectional view showing a cross-section exposed portion of a plurality of dummy patterns 26 exposed by cutting the nozzle substrate along a chain line (scribe line) indicated in FIG. 9B.

In this embodiment, the dummy pattern 26 before the cutting of the nozzle substrate has a shape having substantially the same constitution as an orifice 6 as a part of the nozzle (hereinafter referred to as an "orifice dummy pattern 26A"). The orifice dummy pattern 26A roughly has a circular truncated cone-like shape, so that the shape of the cross-section exposed portion of the orifice dummy pattern 26A varies depending on a position in which the nozzle forming member 9 is cut.

That is, a taper angle appearing in a cutting plane in the case where the cutting plane is deviated from a center line of the orifice portion is larger than that in the case where the cutting plane is aligned with the center line of the orifice portion. Therefore, when an arrangement direction of many orifice dummy patterns 26A is non-parallel with the scribe line 2, even in the case of a varying cutting position, there is some orifice dummy pattern 26A with a cutting plane substantially aligned with the center line of the orifice portion.

By utilizing this fact, as shown in FIG. 9B, a plurality of orifice dummy patterns 26A each having substantially the same dimension as the tapered orifice 6 is arranged in an array on the scribe line 2 so that an arrangement direction (line) is non-parallel with the scribe line 2. Then, an orifice dummy pattern to be subjected to dimension measurement is selected from the plurality of orifice dummy patterns 26A at the cross-section exposed portion depending on manufacturing variation in cutting position with respect to the nozzle forming member 9.

During the cutting of the nozzle substrate, a normal taper angle appears in the case where the cutting plane is aligned with the center line of the orifice position. Therefore, of several orifice dummy patterns 26A appearing in the cutting plane, an orifice having the smallest taper angle is selected and subjected to measurement, so that it is possible to measure the taper angle with high accuracy.

For example, in FIG. 9C, an orifice dummy pattern 26A having the smallest taper angle may be selected from a plurality of orifice dummy patterns 26A appearing in the cutting plane of the nozzle forming member 9. By measuring a dimension of the cross-section exposed portion of the selected orifice dummy pattern 26A, it is possible to control a manufacturing dimension of the orifice with satisfactory accuracy.

As described above, by arranging the plurality of dummy patterns on the cutting line in a non-parallel manner and appropriately selecting a dummy pattern to be measured from the plurality of dummy patterns, it is possible to perform a shape observation and dimension measurement of a desired nozzle with accuracy. Particularly, it is possible to perform high-accuracy measurement even with respect to such a shape that a cross-section varies depending on the cutting position as in the case of the orifice dummy patterns described in this embodiment.

Embodiment 3

Figure 10A:
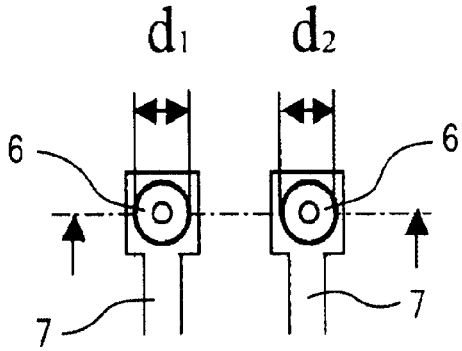
FIG. 10A is a plan view of a nozzle in a Third Embodiment and FIG. 10B is a schematic sectional view of a nozzle substrate cut along a plane indicated by a chain line shown in FIG. 10A.
Figure 10B:
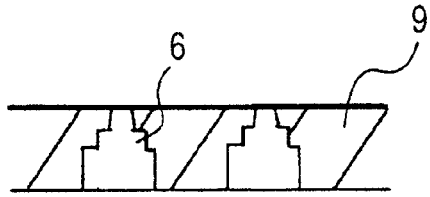

FIG. 10A is a plan view of a nozzle in a Third Embodiment and FIG. 10B is a schematic sectional view of a nozzle substrate cut along a plane indicated by a chain line shown in FIG. 10A.

Figure 11A:
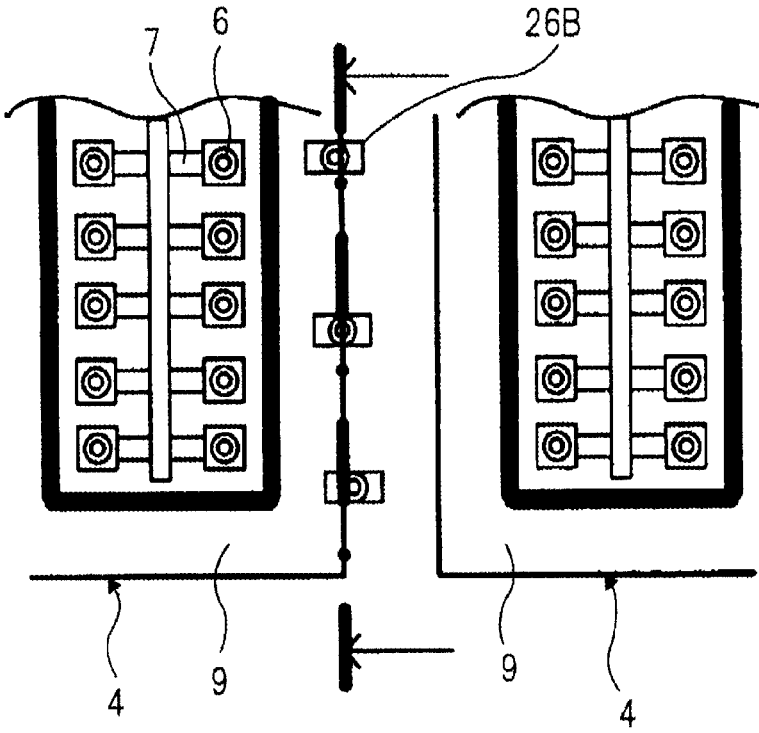
FIG. 11A is an enlarged view of a nozzle in the Third Embodiment at a periphery of a scribe line and FIG. 11B is a schematic sectional view showing a cross-section exposed portion of a plurality of dummy patterns exposed by cutting the nozzle along a scribe line shown in FIG. 11A.
Figure 11B:
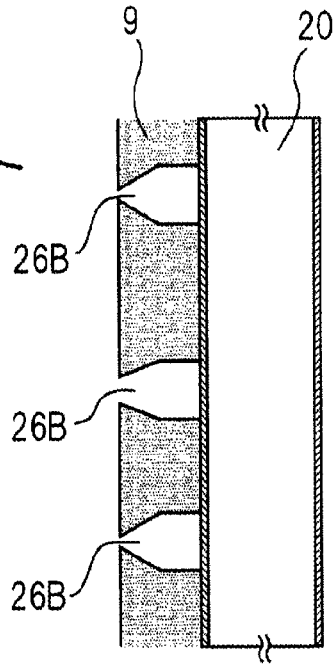

FIG. 11B is an enlarged view showing a periphery of a scribe line 2 for cutting the nozzle substrate in this embodiment into a plurality of portions and FIG. 11B is a schematic sectional view showing a cross-section exposed portion of a plurality of dummy patterns 26 exposed by cutting the nozzle substrate along a chain line (scribe line) indicated in FIG. 11A.

Each orifice 6 in this embodiment is formed in a multi-stepped portion-like shape at an opening-side surface as shown in FIG. 10B. This multi-stepped portion-like orifice 6 has a cross-section which is symmetric with respect to a center line of an orifice portion and is stepwisely decreased in an opening size (diameter) with a decreasing distance from an ejection port.

On the other hand, the dummy pattern 26 before the cutting of the nozzle substrate has a shape having substantially the same constitution as the multi-stepped portion-like orifice 6 as a part of the nozzle (hereinafter referred to as an "orifice dummy pattern 26B"). The orifice dummy pattern 26A has such a multi-stepped portion-like shape, so that the shape of the cross-section exposed portion of the orifice dummy pattern 26B varies depending on a position in which the nozzle forming member 9 is cut.

In this embodiment, as shown in FIG. 11A, a plurality of orifice dummy patterns 26B each having substantially the same dimension as the multi-stepped portion-like orifice 6 is arranged in an array on the scribe line 2 so that an arrangement direction (line) is non-parallel with the scribe line 2. Then, an orifice dummy pattern to be subjected to dimension measurement is selected from the plurality of orifice dummy patterns 26B at the cross-section exposed portion depending on manufacturing variation in cutting position with respect to the nozzle forming member 9.

During the cutting of the nozzle substrate, a normal multi-stepped portion-like shape appears in the case where the cutting plane is aligned with the center line of the orifice position. Therefore, of several orifice dummy patterns 26B appearing in the cutting plane, an orifice having a shape closest to the normal multi-stepped portion-like shape is selected and subjected to measurement, so that it is possible to measure the taper angle with high accuracy.

For example, in FIG. 11B, an orifice dummy pattern 26B having a shape closest to a cross-sectional shape in the neighborhood of an orifice central portion may be selected from a plurality of orifice dummy patterns 26B appearing in the cutting plane of the nozzle forming member 9. By measuring a dimension of the cross-section exposed portion of the selected orifice dummy pattern 26B, it is possible to control a manufacturing dimension of the orifice with satisfactory accuracy.

According to this embodiment as described above, it is possible to exercise dimension control with respect to the multi-stepped portion-like orifice 6 which was less measurable due to a difference in refractive index between the ambient air and the nozzle forming member 9 in the case of microscope observation from above the nozzle forming member 9.

That is, as described above, in the present invention, the dummy pattern having substantially the same dimension as the nozzle is provided on the scribe line and is disposed so that a cutting plane by cutting (scribing) is exposed. Further, the array of the dummy patterns is disposed so as to be non-parallel with the scribe line (cutting line). As a result, the present invention can achieve the following three effects. It is possible to perform measurement with accuracy even with respect to a cross-sectional shape varying depending on the cutting position. It is possible to perform measurement with reliability even when the cutting line varies. It is possible to measure even a position in which it was difficult to perform measurement in microscope observation from above the nozzle forming member.

In the above-described Embodiments, the ink jet recording head for ejecting ink droplets by causing the ink to generate bubbles and heat is employed. However, the present invention is not limited thereto but is also applicable to liquid ejecting heads in general capable of ejecting liquid in the form of a droplet.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 315820/2007 filed Dec. 6, 2007, which is hereby incorporated by reference herein.

What is claimed is:

1. A manufacturing dimension control method comprising:

providing a liquid ejecting head including a substrate and a nozzle forming member for forming, on a principal surface of the substrate, a nozzle comprising a flow passage of liquid and an orifice for ejecting the liquid;

forming a dummy pattern having substantially the same dimension as at least a part of the nozzle so that a cross-section of the dummy pattern is exposed at an end surface of the nozzle forming member; and controlling a manufacturing dimension of the nozzle by measuring a dimension of a cross-section exposed portion of the dummy pattern, wherein the dummy pattern includes a plurality of dummy pattern portions which are formed in an array so that a cross-section of each dummy pattern portion is exposed at an end surface of the nozzle forming member, and wherein an arrangement direction of the array of the plurality of dummy pattern portions and the end surface of said nozzle forming member are non-parallel.

2. A method according to claim 1, wherein the dummy pattern has a substantially same dimension as the flow passage.

3. A method according to claim 1, wherein the dummy pattern has a substantially same dimension as the orifice.

4. A method according to claim 1, wherein at least a part of the cross-section exposed portion of the dummy pattern is provided by cutting the nozzle forming member, and wherein a dummy pattern portion is selected from the dummy pattern portions, each having the cross-section exposed portion.

5. A method according to claim 4, wherein the liquid ejecting head includes the dummy pattern portions having the cross-section exposed portions which vary in shape depending on a cutting position of the nozzle forming member.

6. A manufacturing dimension control method comprising:

providing a wafer for forming a liquid ejecting head including a substrate and a nozzle forming member for forming, on a surface of the substrate, a plurality of nozzles comprising a plurality of flow passages of liquid and a plurality of orifices for ejecting the liquid, and including a plurality of dummy patterns shaped correspondingly to the plurality of nozzles, wherein the plurality of nozzles are arranged in a rectilinear line and the plurality of dummy patterns are arranged non-parallel to the plurality of nozzles arranged in the rectilinear line;

cutting the wafer so that at least one of the plurality of the dummy patterns is cut; and measuring a dimension of a cross-section exposed portion of the cut dummy pattern.

* * * * *